United States Patent [19]

Neel

[11] 4,423,676

[45] Jan. 3, 1984

[54] METHOD AND APPARATUS FOR PRINTING COMPOSITE DESIGNS ON FABRIC

[75] Inventor: Keenar A. Neel, Concord, N.C.

[73] Assignee: Cannon Mills Company, Kannapolis, N.C.

[21] Appl. No.: 325,093

[22] Filed: Nov. 25, 1981

Related U.S. Application Data

[63] Continuation-in-part of Ser. No. 261,693, May 8, 1981, abandoned.

[51] Int. Cl.[3] ..... B41M 1/12; B41F 31/28; B05C 9/06

[52] U.S. Cl. ..... 101/211; 101/116; 101/129; 101/172; 101/181; 101/DIG. 25; 118/46

[58] Field of Search ..... 101/172, 211, 115, 116, 101/129, DIG. 25; 118/46, 669

[56] References Cited

U.S. PATENT DOCUMENTS

| | | | |
|---|---|---|---|
| 1,189,453 | 7/1916 | Johnston | 101/172 |
| 1,538,951 | 5/1925 | Pringle | 101/115 |
| 2,154,363 | 4/1939 | Seybold | 118/46 |
| 2,549,605 | 4/1951 | Huck | 101/181 |
| 2,610,578 | 9/1952 | Paasche | 101/115 |
| 3,106,480 | 10/1963 | Baker | 101/172 |
| 3,292,532 | 12/1966 | Berk | 101/115 |
| 3,594,552 | 7/1971 | Adamson | 101/181 |
| 3,620,662 | 11/1971 | Miycmoto | 101/172 |
| 3,702,404 | 11/1972 | McDermitt | 118/669 |
| 3,840,421 | 10/1974 | Peterson | 101/181 |

FOREIGN PATENT DOCUMENTS

| | | | |
|---|---|---|---|
| 2001780 | 7/1971 | Fed. Rep. of Germany | 101/115 |
| 139618 | 3/1920 | United Kingdom | 101/115 |
| 414589 | 8/1934 | United Kingdom | 101/115 |
| 1201598 | 8/1970 | United Kingdom | 101/172 |
| 1456458 | 11/1976 | United Kingdom | 101/172 |

*Primary Examiner*—Clyde I. Coughenour
*Attorney, Agent, or Firm*—Hubbell, Cohen, Stiefel & Gross

[57] ABSTRACT

Variegated composite designs (11) are printed on a surface of a length of fabric (12) by a two-stage printing process in which first, sharp, unmodulated color background portions (14) of the design are first applied by a conventional contact printer (13) such as a rotary screen printer in one example. Next, the partially printed fabric is advanced to an airbrush printing station located downstream from the final stage of the contact printer, where a plurality of airbrushes (21) are selectively operated to apply variable color tone portions or features (22) to the fabric adjacent to the background portions previously printed, in either the same or contrasting color or colors so as to produce a variegated composite design including the airbrushed portions superimposed on and embellishing the background sharp color portions previously printed. Operation of the airbrushes and contact printer is synchronized (FIGS. 1, 2–24, 27; FIGS. 3–7–61, 62) so as to provide a variety of artistic effects by compositing of the standard contact printing and airbrush spray printing patterns.

12 Claims, 7 Drawing Figures

20

30
13
34
21
T
Ø
41
39
50
33
31
A
12
19
21
50
21
50
50
X
43
21
23
Y
5
5
4
4
41
34

METHOD AND APPARATUS FOR PRINTING COMPOSITE DESIGNS ON FABRIC

RELATED APPLICATION

This application is a continuation-in-part of my earlier application, Ser. No. 261,693, filed by me on May 8, 1981 for *METHOD AND APPARATUS FOR PRINTING COMPOSITE DESIGNS ON FABRIC, AND PRINTED FABRICS SO PRODUCED,* assigned to the assignee hereof, now abandoned.

TECHNICAL FIELD

This application relates generally to methods and equipment for printing variegated composite designs on a length of fabric and to printed fabrics so produced, and more particularly to printing of composite designs having background sharp, ungraduated color portions printed by conventional contact printing equipment combined with variable tone embellishments superimposed on the background design portions by airbrush printing equipment positioned downstream from the contact printing station as an adjunct to the contact printer.

BACKGROUND ART

Various different types of contact printers are well known in the art for printing sharp, ungraduated color designs on textile fabrics, such as flatbed silk screens, engraved copper rollers, or rotary screen printers. Such printers are described, for example, in Belko U.S. Pat. No. 3,260,196; Vertegaal U.S. Pat. No. 3,718,086; Boyer et al U.S. Pat. No. 3,769,058; Ichinose U.S. Pat. Nos. 3,774,534 and 4,079,674; Zimmer U.S. Pat. No. 3,942,438; and Kudlich et al U.S. Pat. No. 4,114,534. These printers are capable of printing intricate designs in various colors and with sharply delineated edges to produce printed cloth of all kinds.

In order to provide increased flexibility in artistic design and a much wider choice of possible designs, it would be desirable to provide a way to add to the standard contact printing process a technique for embellishing a basic contact printed design by superimposing variable colortone portions in the same or contrasting colors to provide variegated composite designs including the combination of variable tone, soft design portions superimposed on the sharp, ungraduated color background, contact printed portions. As used herein and throughout the following specification, the reference to variable tone, soft design portions of the composite printed designs hereof is intended to refer to printed images having continuous tonal gradations and indistinct edges such as produced by airbrushing, as distinguished from sharp, unmodulated color design portions having clear-cut edges such as produced by conventional contact printing techniques.

Jet spray printers have in fact been disclosed, particularly for use in the carpet printing industry, for the application of printed patterns to textiles independent of designs formed thereon by conventional means. Such jet printing operations are described, for example, in Textile Industries, May, 1980, pages 46, 48; and in the American Dyestuff Reporter, June, 1980, pages 33, 34 and 54. Prior jet printing operations have, however, required the use of independent, line-by-line computer controls, and have not involved the direct synchronization with, and control by, standard contact printing processes with which they may be utilized.

DISCLOSURE OF THE INVENTION

It is, accordingly, a specific object of the present invention to provide an adjunct or addition to a contact printer which is operated in synchronism with such a printer and which embellishes sharp color contact printed designs by adding soft, variable colortone features in registration with previously contact printed background design portions, and to provide novel fabrics having such composite designs printed thereon.

More general objects are to provide new and improved methods and apparatus for the synchronized two-stage printing of composite designs having background sharp color contact printed design portions and variable colortone embellishments superimposed on the background positions by an ink spraying process such as airbrushing.

With the foregoing and other objects in view, printing equipment and methods in accordance with certain features of the invention include a conventional contact printer located at a first printing station, for printing first, sharp color background portions of a desired composite design along a surface of a length of fabric advanced therethrough, the contact printed positions of the design being of sharp, distinct color with clear cut edges.

Following this, the fabric is advanced to a second printing station, at which one or more airbrushes are positioned for applying variable colortone portions of the desired final design to the previously printed background portions. Means are further provided for synchronizing the operation of the airbrushes with the contact printer so as to produce a composite variegated design including the background ungraduated color portions first printed embellished by and in registration with the variable tone airbrushed portions superimposed thereon. A product in accordance with the invention includes a length of fabric having a variegated composite design printed in accordance with such a method.

The operation of the airbrush unit may be synchronized in a number of ways with the background design deposited by the contact printer so that the added design features register precisely with the background portions of the design. In a preferred embodiment, a trigger marking is formed at a preset point on the periphery of a rotating roller that is synchronized with the print rollers so that the location of the marking corresponds to a known point along the repeating background pattern. In this example, a fixed sensor such as a photocell is triggered by the rotating marking to operate the airbrushes at a precise point relative to the pattern. Alternatively, a trigger marking may be deposited on the fabric at spaced intervals along the length thereof corresponding to the pattern repeat, and each trigger marking thereafter sensed to trigger the operation of the airbrushes.

In one embodiment of the invention, a plurality of airbrush guns are mounted at a final printing station located downstream from a conventional rotary screen printing station having a number of rotary print screens mounted in a horizontal row for printing the background design, usually in several colors. The airbrush guns are mounted in a transverse row above and across the fabric parallel to the print screens. The guns are adjustably positioned on a mounting block so that the position of each gun may be adjusted and set either transversely or vertically with respect to the pattern, and so that the angle of each gun to the horizontal and vertical can be adjusted so as to precisely locate the ink streams from one or more guns with respect to selected areas on the fabric and to set desired sizes for the airbrushed design areas.

Other objects, advantages and features of the invention will be apparent from the following detailed description of specific examples and embodiments thereof, when read in conjunction with the accompanying drawings.

BEST MODE FOR CARRYING OUT THE INVENTION

Figure 1:
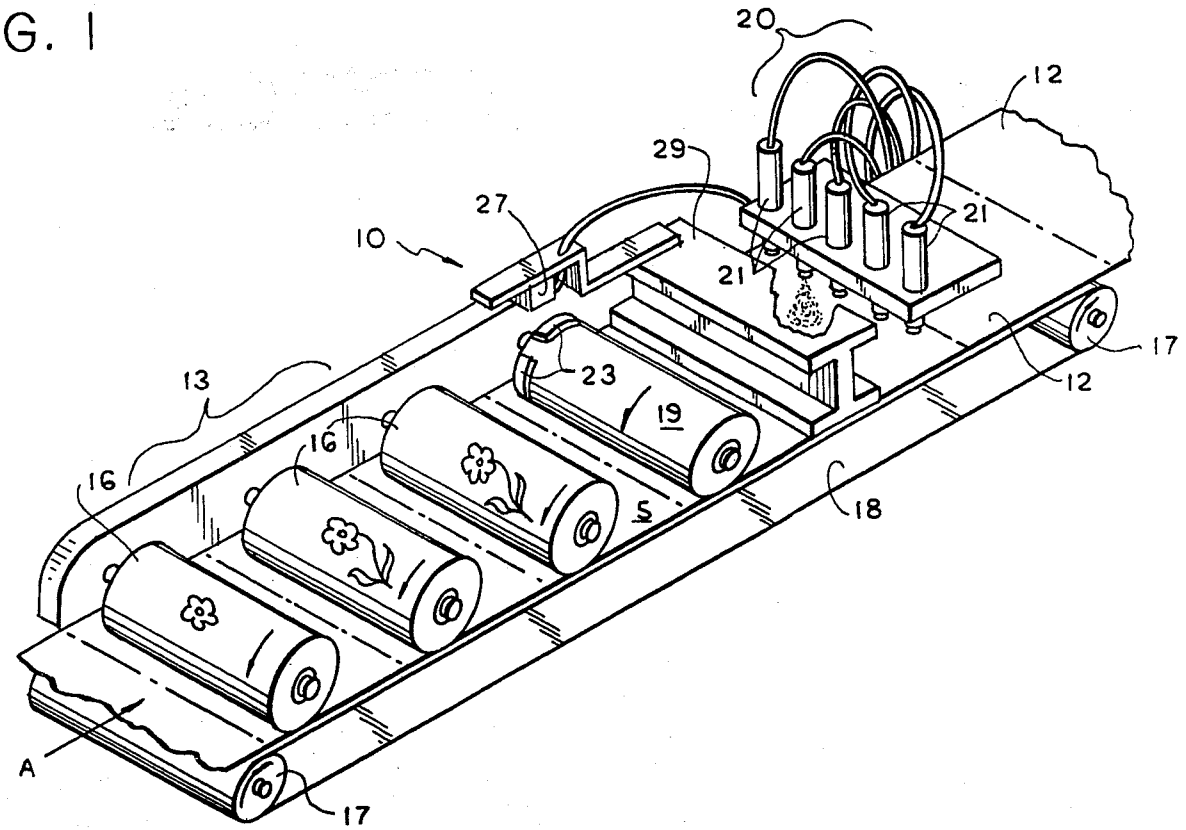
FIG. 1 is a somewhat schematic perspective view of a two stage printing process and equipment including a contact printing station and an airbrush printing station in accordance with certain features of the invention.
Figure 2:
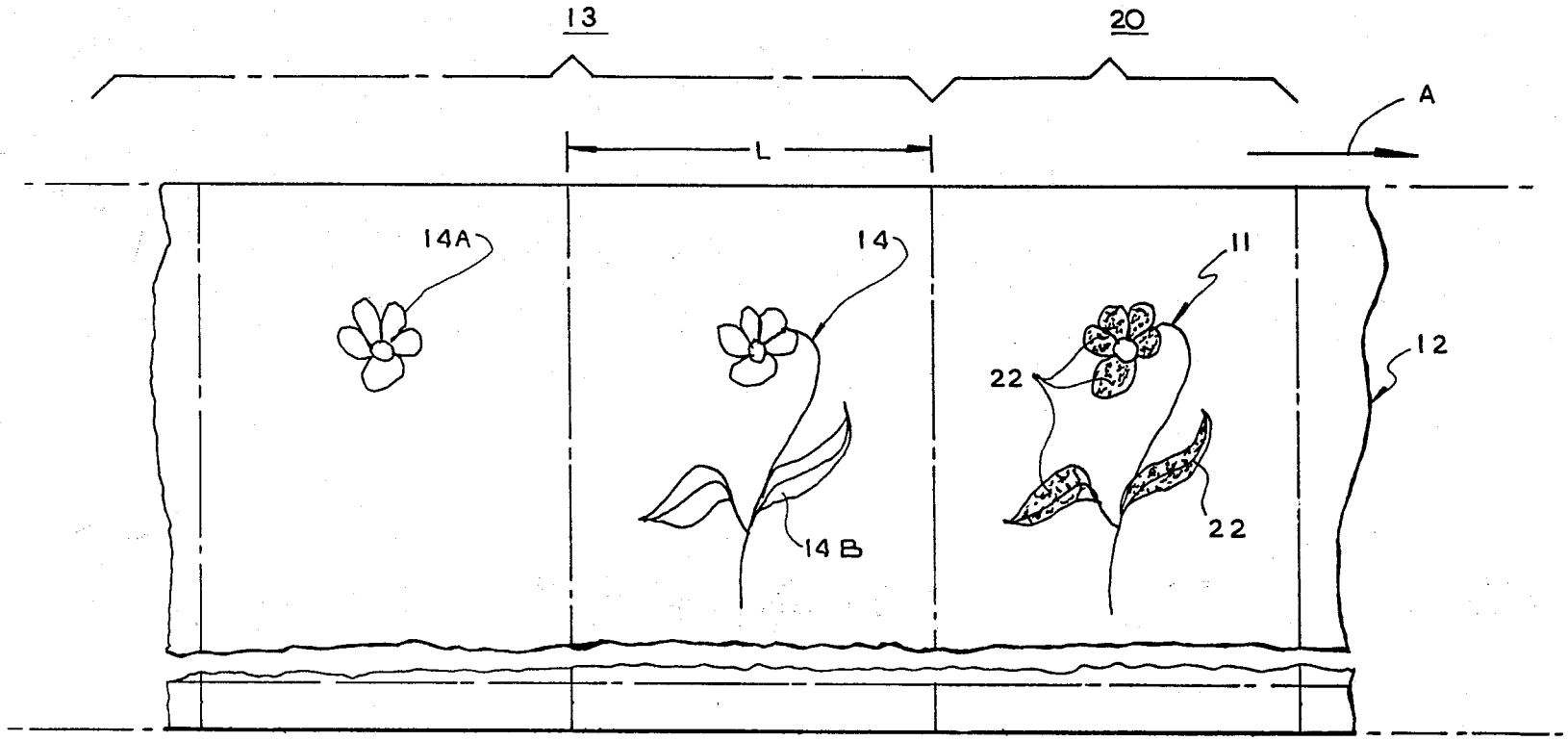
FIG. 2 is a plan view of a portion of a length of fabric having a variegated composite design printed thereon in accordance with the invention.

Referring now in detail to the drawings and particularly to FIGS. 1–2, printing apparatus 10 and methods in accordance with one specific embodiment of the invention are designed for printing in two sequential stages a special type of variegated composite design 11 in accordance with the invention on a surface 5 of a length of textile fabric or cloth 12 such as the thin textile fabrics used in draperies, slip covers, tablecloths, or other forms of interior decoration, or in the clothing industry or the like, or the thick fabrics such as terry cloth, velvets, velveteens, corduroys, knits, Lodens or the like. In the process, the fabric 12 is advanced from left to right (arrow A) to a first printing position or station 13, which is a conventional contact printing station at which first, sharp color background portions 14 of the desired composite design 11 are printed on the fabric in one or more colors with clear cut edges in conventional manner. While many different types of contact printers can be used, such as flatbed silk screens, engraved copper rollers, or rotary screens, the contact printer 13 illustrated in FIG. 1 is a conventional rotary screen printer having, for example, three rotating cylindrical print screens 16—16 arranged in a row along the line of advancement A of the fabric 12 (from left to right, as shown in FIGS. 1 and 2), for printing desired patterns or designs on the fabric 12, for example in three colors using three screens 16, to print a repeating succession of patterns including the background portions 14 for the composite designs 11 at predetermined repeat intervals L along the length of the fabric 12 as the fabric is advanced through the first or contact printing station 13.

After the contact printing step, the fabric is advanced, as by a pair of conventional feed rollers 17—17 about which blanket 18 extends for advancing the fabric, to a secnd or airbrush printing station 20 located a predetermined distance downstream from the final stage of the first station 13, where a plurality of airbrushes 21—21 are selectively operated to apply variable colortone portions or design features 22 to the surface of the fabric adjacent to the previously printed background portions 14 of the design. A variegated composite design 11 is thus produced composed of the background sharp color portions 14 printed at the first station 13 embellished by the variable tone airbrushed portions 22 superimposed on the background portions at the second station 20.

Contact printing has the advantage of being able to rapidly produce at low cost endless lengths of printed fabric with large areas of repeating sharp (unmodulated) color patterns in various colors having sharply delineated edges. The airbrush technique, on the other hand, provides a "soft" color tone effect, and can produce variations or gradients in the colortone from a relatively faint color to a relatively intense color which, where desired, can match the sharp colors applied by the conventional contact printer 13. The basic airbrushing techniques and equipment are well known in the art, and involve spraying droplets of ink or dye from a nozzle similar to an ink jet.

Accordingly, by combining a standard contact printer 13 with an airbrush printer 20 positioned downstream from the contact printer and synchronized therewith, a wide variety of intricate composite designs 11 can be produced using either the same or often different colors to achieve a variegated composite pattern having both the clear cut sharp images generated by the prior art contact printers and the soft and variable tone embellishments generated by the airbrush technique.

For example, in the fabrication of an intricate artistic design such as a flower for example, the basic outline of the design can be printed in sharply delineated form from one to three or more colors by the contact printer, and then the embellishments such as petal coloration or leaf shading can be added in soft and gradual tones by the airbrushes.

In a simple example of the process for producing a composite flower design 11 as illustrated in FIG. 2, the basic outline of the blossom (14-A) at the left in FIG. 2 is printed in sharp black ink or dye by one of the print screens 16 and the outline of the stem and leaves (14-B) is added by the following screen 16. Following this, one of the airbrushes 21 applies petal coloration (22) within the bloom area 14-A in a contrasting color such as a soft pink or yellow fading in intensity toward the edges of the blossom from dark to light. Similarly, the leaves are airbrushed to effect contours and highlights (22) within the leaf outlines (14-B) using a shaded green-on-green ink with tonal shadings as illustrated. This highly simplified example is illustrative of the principles of the invention in providing an endless variety of variegated composite designs 11 having sharp color contact printed background portions 14 embellished by the variable, modulated tone airbrushed portions 22 superimposed on the background portions to produce a decorative composite design 11 by the combination of the two processes in a single printer 10.

In the process, the airbrushes 21—21 are selectively turned on and off in timed relationship with the movement of the partially printed fabric as it moves through the printer 10 so as to provide the desired airbrush effect in the selected color to each selected background design portion 14 of the repeating pattern as the fabric is advanced through the printer, whereas the remainder of the pattern has the usual sharp type of printing color applied by the standard contact printing process. Obviously, the periodicity and "on" time of each selected airbrush 21 used in a particular pattern is dependent upon the size of the background portion 14 of the pattern to be colored and its location. Thus, if a particular design is repeated twice in a row (from left to right in FIGS. 1–2), in one repeat (L) of the fabric portion of the design, then the particular airbrush 21 that tints that portion of the design will be actuated twice during each repeat and for the required amount of time to spray the ink or the dye to color the size of the portion being so colored.

While in the preferred embodiment described herein the airbrushes 21—21 are fixed in position and are actuated in time relation to the advancement of the fabric 12, it will be apparent to those skilled in the art that, if desired for particular applications, the airbrushes may themselves be moved across the fabric (longitudinally and/or tranversely thereof). It thus suffices that the fabric 12 and the airbrushes 21—21 are moved relative to one another, and that operation of the airbrushes is synchronized with operation of the contact printer 10.

In general, the operation of such airbrush units and control devices and circuits for turning selected airbrushes on and off at desired times and for moving the brushes across the fabric at synchronized speeds to deposit the desired patterns are well known, and are similar also to control systems used in ink set printing systems of various kinds.

One suitable example of an airbrush unit 21 useful in the practice of the invention is the Binks Model 21 (63BX63PB) spray gun having an air operated trigger system to provide for automatic initiation and termination of the ink spray. The operation of such a unit may be actuated by a solenoid switch, e.g., an ASCO 3-way ¼" valve (110 v.) (Cat. No. 6320 A89), in conjunction with a Norgreen ¼" air regulator.

The on time and off time control cycles for the airbrushes 21 can be established in any conventional fashion, such as by cams or control devices similar to a jacquard automat, by limit switches or by a microprocessor.

As indicated hereinabove, the airbrush operation is synchronized with the operation of the contact printers 13 to assure precise registration of the airbrushed design features 22 with the previously printed background design portions 14 as previously described, to produce the composite design patterns such as 11. This can be done in various ways, such as by a positive physical correlation or triggering linkage mechanism between one of the contact printing screens 16 and the airbrush unit so as to indicate automatically the start of each repeat pattern area (L) on the fabric 12.

The presently preferred means for controlling the air brushes 21 to cause them to operate in synchronism with the movement of the fabric 12 is illustrated in FIG. 1. Referring to FIG. 1, a control roller 19 of construction substantially identical to the screen rollers 16 is rotably mounted transverse of the direction movement of the fabric 12 downstream from the downstream most roller 16. Affixed to the periphery of roller 19 is a suitable reflective means such as an adhesive backed metalized reflective tape 23 affixed to the periphery of the roller 19. Disposed above the metalized tape 23 is a photocell 27 mounted on a support bracket secured by suitable means to an eye beam 29 extending transversely of the direction of movement of fabric 12.

The photocell (Warner "Visolux" MCS-144 photocell is currently preferred) detects ambient light reflected off the reflective tape 23, although a special lamp could be provided for this purpose, if desired. The position of the tape 23 about the periphery of the roller 19 will cause the photocell 27 to fire or be dormant in accordance with the tape pattern, whereby to actuate or leave inactive the air brushes 21 which are controlled by the photocell.

With such an arrangement, it will be obvious that the timed actuation of the air brushes 21 can readily be changed by a simple expedient of stripping tape 23 from roller 19 and replacing it with other reflective tape taped in a different pattern about the periphery of the roller 10. Moreover, if desired, a plurality of photocells could be employed and could be connected to a selected one or ones of the air brushes 21 to actuate them at different times through a pattern repeat which must be the same for roller 19 and tape 23 as it is for the rollers 16. While it is presently preferred to employ roller 19, it will be obvious that control of photocell 27 could be accomplished by reflective tape 23 on one of the printing rollers 16.

While the control system for the air brushes 21 shown in FIG. 1 is currently preferred, it will be obvious that other control means could be employed. For example, the photocell 27 could be trained at a specific portion of the pattern printed by the roller 16 to actuate the air brushes in timed relation with the movement of the pattern, or special actuating indicia could be printed on fabric 12 for detection by the photocells 27.

Referring now to FIGS. 3–7, there is illustrated a specific form of two-stage composite printer 30 in accordance with a currently preferred embodiment of the invention, including a conventional contact printing section 13 and an airbrush station 20 positioned downstream from the last rotary print screen 16 for printing composite designs as described above on a length of fabric 12 that advances through the printer as indicated by arrow A (from right to left, as shown in FIGS. 3–7). In this example, the screen 16 illustrated comprises the last screen in a row of, for example, six printing screens for applying a basic design in up to six colors to the fabric 12 as previously described. As previously mentioned, the screen printing techniques and equipment are well known and will not be described in any detail herein.

Figure 3:
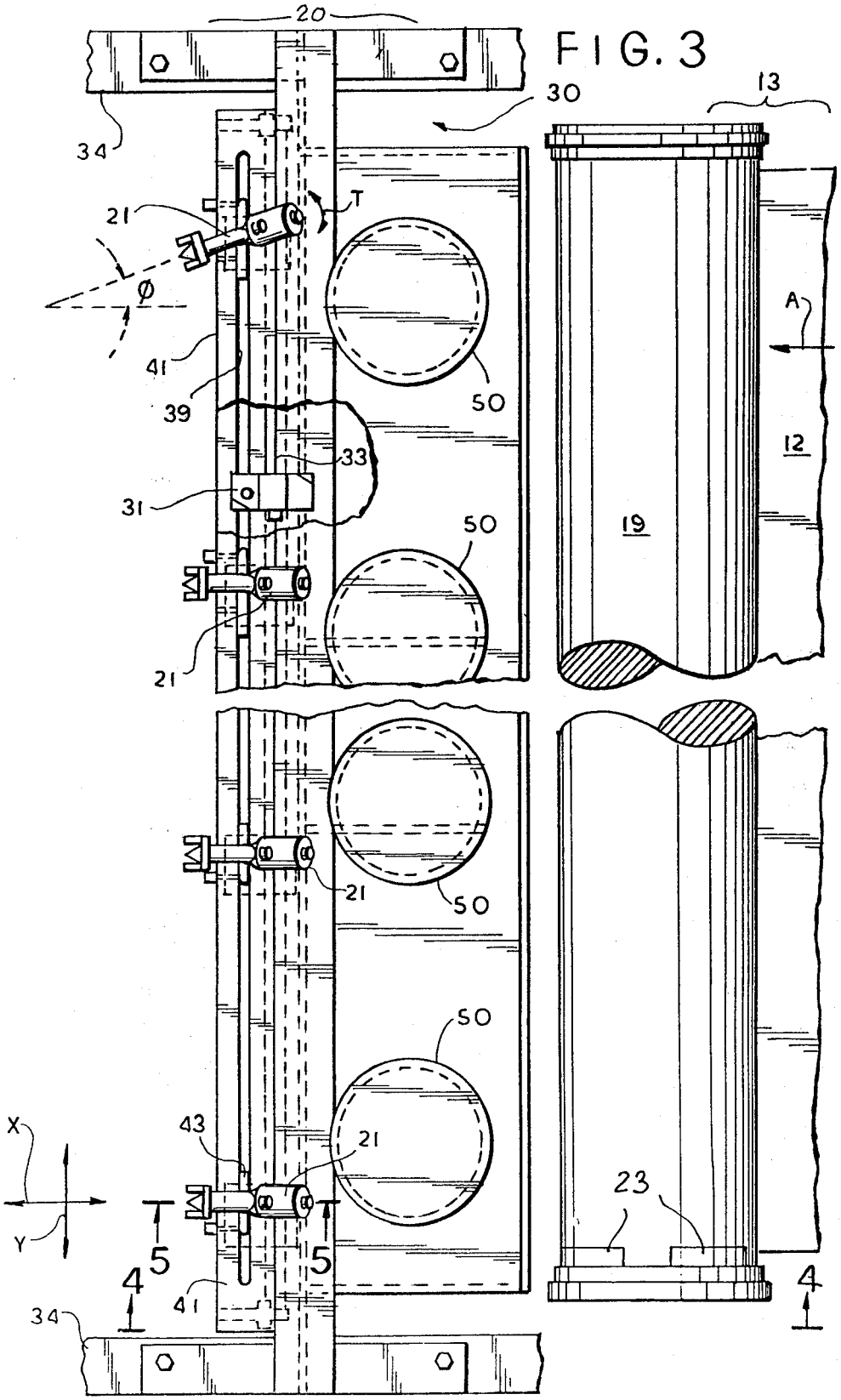
FIG. 3 is a plan view of a printing installation in accordance with one specific embodiment of the invention including a contact screen printing station followed by an airbrush printing station.
Figure 5:
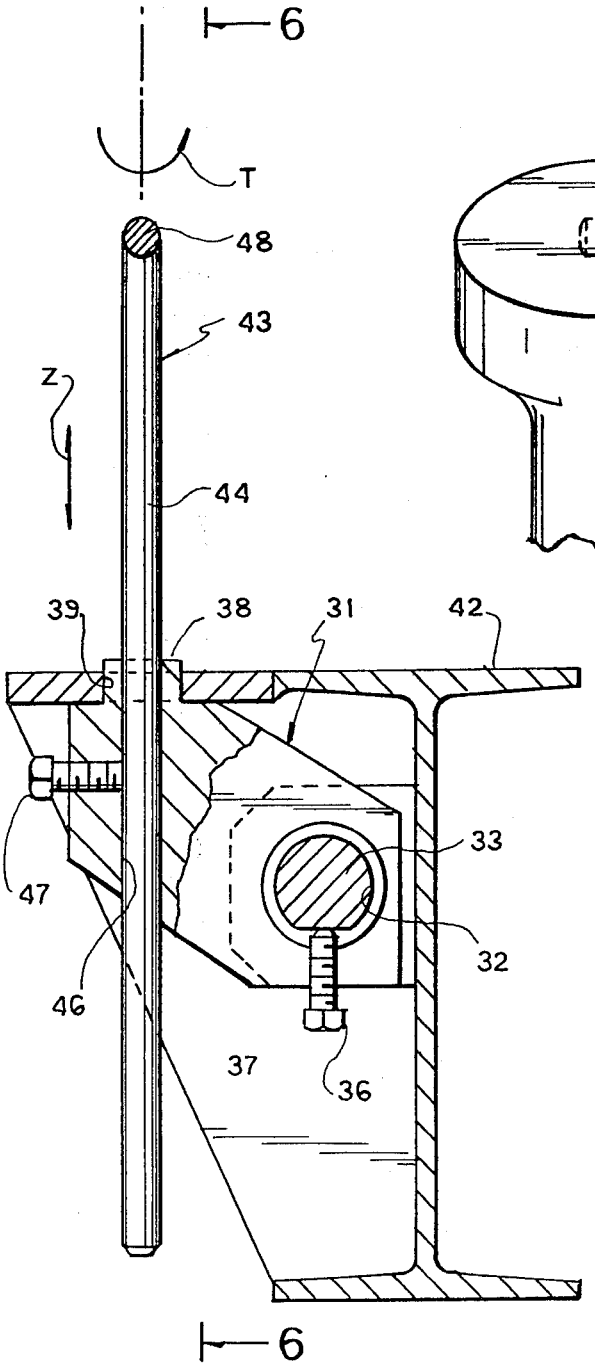
FIG. 5 is an enlarged, fragmentary vertical section along line 5—5 in FIG. 3 illustrating portions of the apparatus for mounting an airbrush gun and positioning it with respect to the fabric to be printed.

A row of, for example, six airbrush spray guns 21—21 is mounted across the width of the machine from top to bottom in FIG. 3 as illustrated so that the position of each gun may be adjusted transversely across the width of the machine (arrow Y) to print augmented design features as described above centering about a selected longitudinal line X extending along the length of the fabric in the direction of advancement. Each gun is so mounted for transverse sliding movement (Y) on a generally rectangular guide or mounting block 31. As best illustrated in FIG. 5, each guide block 31 is formed with a cylindrical bore 32 therethrough in the transverse horizontal direction Y, which is slideably mounted on a transverse, generally cylindrical slide rod 33. The slide rod 33 is fixedly mounted between portions of the machine support frame 34—34 at the opposite sides of the machine. The desired Y position of each gun 21 is set by a set screw 36 that is fastened into a tapped aperture 37 in the base of each block 31 and fits against a flat undersurface of the slide rod 33 so as to fasten the block to the rod 33 in the desired transverse position for the gun 21 carried thereby. An upper rectangular projecting portion 38 of each block 31 is slideably received in a groove 39 of a flat support plate 41 for the gun assemblies that runs the width of the machine and is attached to an I-beam mounting frame 42 that runs the width of the machine between the frame members 34—34 at its sides.

Figure 4:
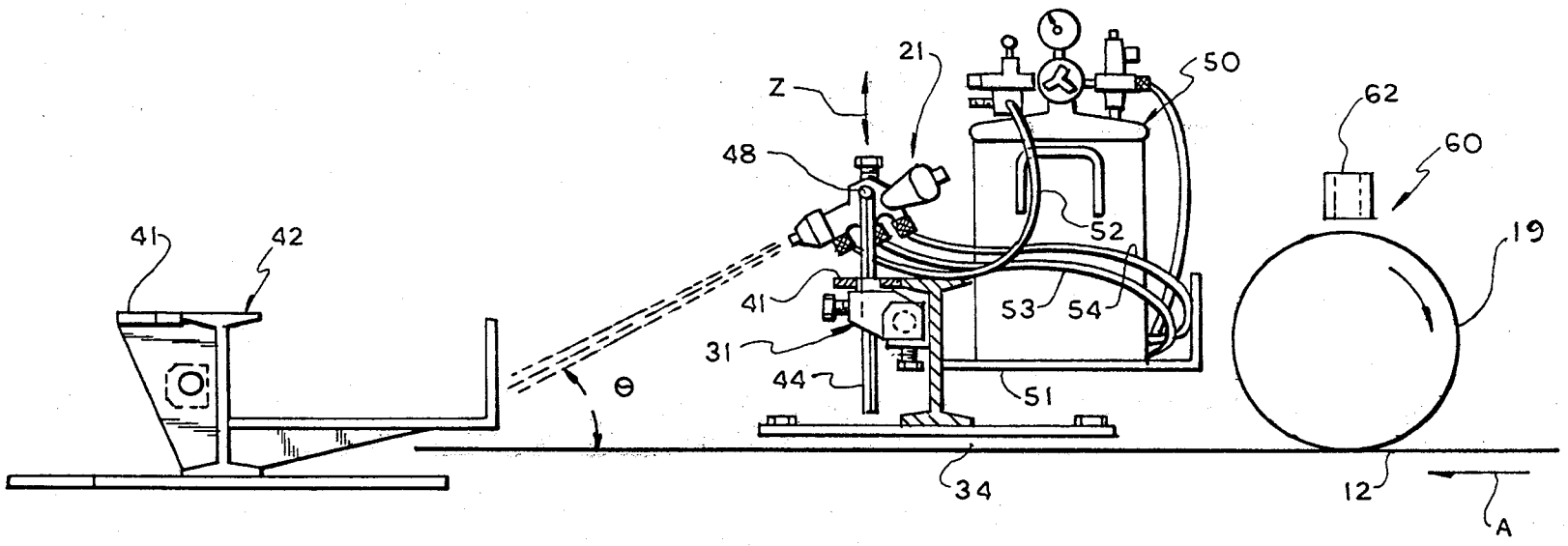
FIG. 4 is a side elevation of the installation, partly in vertical section along line 4—4 in FIG. 3.

Each gun 21 is mounted to its associated guide block 31 by a cylindrical mounting rod 43 having a vertical section 44 that is slideably received in a vertical base 46 for up and down movement as indicated by arrow Z (FIG. 5). Each end is fixed in the companion block 31 by a set screw 47 as to set the vertical height of the gun 21 at any desired position on the mounting rod 43 so as to preset a desired vertical spacing between the nozzle tip of the gun 21 and the advancing fabric 12 as illustrated in FIG. 4. The spacing of the gun nozzle from the fabric (as well as the setting of the nozzle aperture) is determined in accordance with the desired intensity and diameter of the pattern applied to the fabric by the gun (the closer the spacing and the more restricted the aperture, the more intense and limited the spray pattern).

Figure 6:
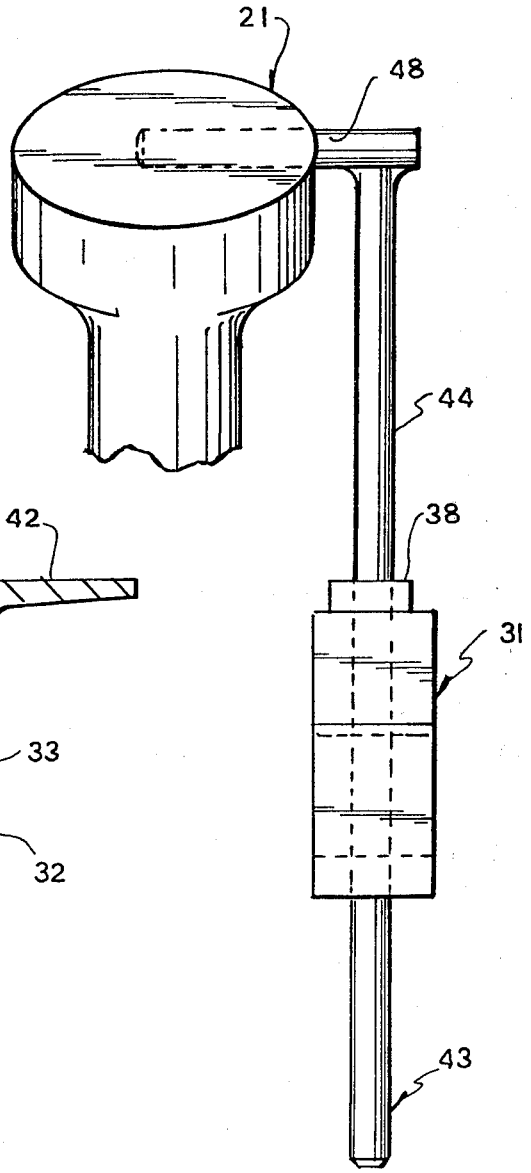
FIG. 6 is a transverse vertical section along line 6—6 in FIG. 5 illustrating further details of the gun mounting mechanism.

The upper end of the mounting rod 43 is formed with a 90° horizontal end section 48 in which the gun 21 is mounted (FIGS. 4, 6). With this arrangement, each gun 21 can also be pivotal about the rod section 48, as indicated by arrow Z in FIG. 4, so as to adjust the angle $\theta$ between the gun and the fabric 12 as illustrated in FIG. 4.

In addition, each mounting rod 43 may be rotated or turned in the vertical mounting bore 46 of the guide block 31, as indicated by arrow T (FIG. 5), so as to set any desired angular position $\phi$ (FIG. 3) between the gun 21 and the longitudinal axis X of the background pattern 14 preprinted on the advancing fabric 12, for example, as depicted with respect to the gun 21 at the top of FIG. 3. By thus swivelling any two adjacent guns and mounting them fairly close together, it is possible to spray the same or overlapping regions along a pattern axis X with two different overlapping colors or to spray a repeating pattern segment 14 first in one color in one segment and in a different color during the next repeat of the pattern. By properly setting the linear positions Y and Z and the angles $\theta$ and $\phi$, it is possible to achieve a wide variety of pattern and tonal effects by simple presetting of these geometrical features of each gun for a given run of fabric. Of course, additional guns or a second row of guns parallel to the row illustrated can be added for even greater diversity of patterns and colors.

In the embodiment illustrated herein the position of each spray gun 21 along axes Y and Z and angles $\theta$ and $\phi$ is manually adjusted. Alternatively, it will be understood that conventional control mechanisms may be added to facilitate automatic adjustment of the position and orientation of the spray gun, as desired.

One major advantage of the airbrush printing station 20 illustrated in FIGS. 3–6 is that it can be added as an attachment to an existing contact screen printing station at very little added cost and without any additional space requirement, since the airbrush installation 20 fits precisely into the space occupied by one of the rotary print screens 16 and it is only necessary to remove the screen 16 from downstream position and add the airbrush assembly 20 as the final printing stage.

As illustrated in FIGS. 3 and 4, a plurality of printing ink or dye supply tanks 50—50, one for each gun 21, are mounted on a flat horizontal support plate 51 extending across the width of the machine and supported by the I-beam frame 42 previously discussed. Each tank 50 is connected to the associated airbrush gun 21 in generally conventional fashion by a first flexible hose 52 for supplying the printing ink to the nozzle of the gun 21, a compressed air hose 53 also being connected to the gun for delivering compressed air to the nozzle for the airbrush printing process. A third air hose 54 delivers compressed air to the trigger of the gun 21 to turn the gun on and off at the desired times. (In FIG. 4, the hose and tank connections have been omitted for purposes of clarity.) In the embodiment illustrated, the tanks, fittings and control valves, regulators and gauges, etc. are conventional binks Model 835,501 equipment. Since the principles of operation of such commercial air-trigger operated spray guns are known in the art and are not of importance to applicant's invention, such operation will not be further described herein.

Figure 7:
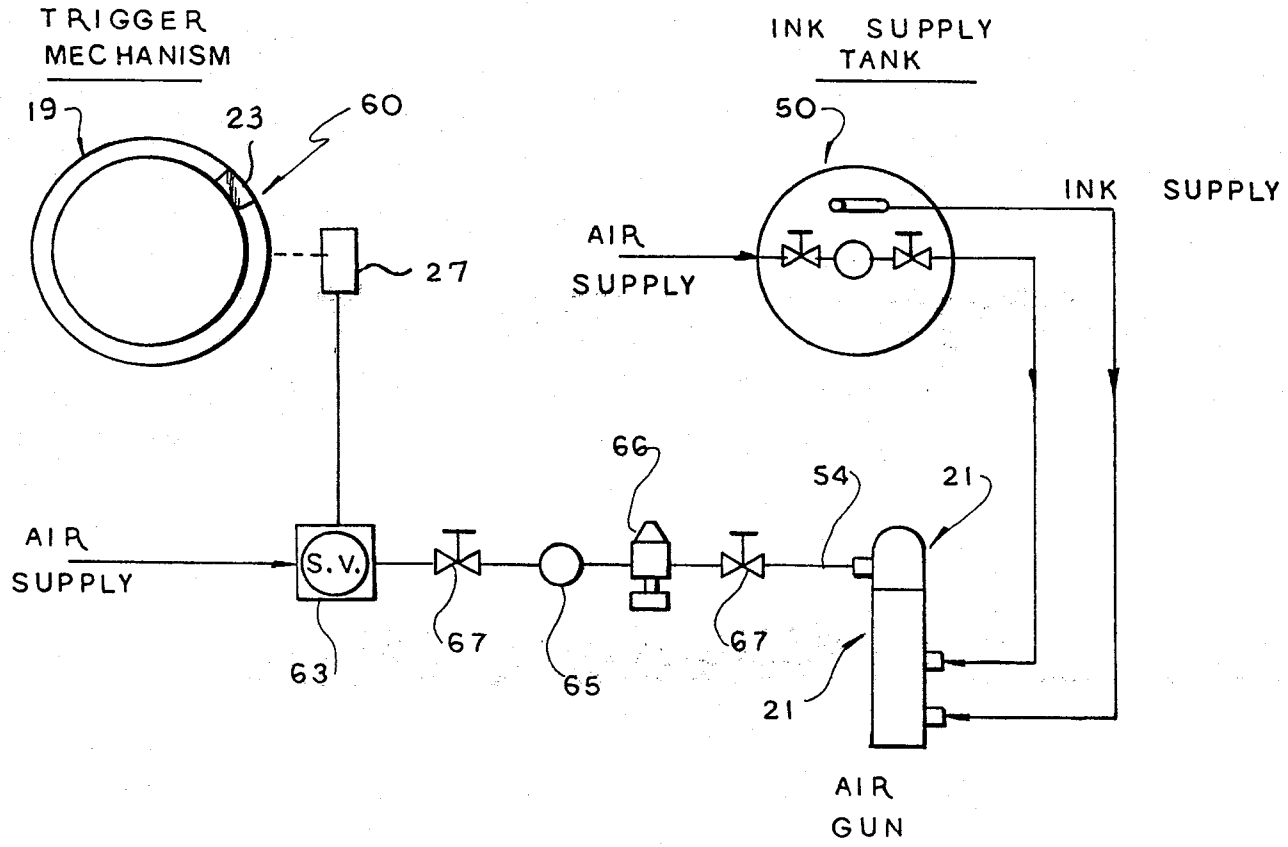
FIG. 7 is a schematic diagram of an electromechanical circuit for operating the airbrushes in synchronized relationship to the contact printer.

As illustrated in FIG. 7, the photocell 27 operates an electrically operated solenoid valve 63 for applying compressed air to the air trigger input 64 of each spray gun 21 via the trigger input hose 54 and a supply line including a filter 65, regulators 66, and control valves 67—67. In the embodiment illustrated each of the spray guns 21 is simultaneously actuated in response to photoelectric detection of the reflecting surface portions 23 on the roller 19. Alternatively, as previously noted individual reflecting surface portions 61 may be provided at different points about the periphery of roller 19 for activating either individual spray guns 21 or predetermined groups thereof. On the other hand, separate reflective markings may be provided for actuating the several spray guns in any predetermined sequence, synchronized with the disposition of the fabric 12 relative to the roller 19. It is thus possible to synchronize the operation of one, several, or all of the spray guns responsive to the disposition of one or several markers associated with the conventional contact printer as it feeds the fabric through the device.

It should be recalled that as an alternative to the synchronizing mechanism illustrated in FIG. 7 an alternative technique described previously, in which the triggering indicia is printed directly on the fabric itself to trigger the airbrushes 21 through a suitable triggering means, such as photocell means, at the proper time and location with respect to the background pattern 14 applied by the contact printer 10. Obviously, many variations are possible in the trigger mechanism for operating the airbrush unit 20, the key feature of interest in this respect being the provision of some form of mechanical indicator or indicium that can be sensed mechanically, optically, magnetically or electrically in some way to trigger the airbrush system 20 in relation to the position of the screened background pattern on the fabric, for example, either by printing on the fabric or by marking on one of the rollers 16 or 19 so as to trigger the airbrush system in proper timed relation relative to the position of the background pattern. Obviously, such equivalent indicia as magnetic tape, or providing a hole in a solid screen, could be employed with appropriate magnetic or photoelectric detectors.

In view of the foregoing description of specific embodiments and examples of the invention, it should be apparent that there have been provided simple and effective techniques and equipment for printing a wide selection of variegated composite designs on the surface of a length of fabric, having various combinations of sharply defined, unmodulated printed background pattern areas with variable tone, airbrushed pattern areas superimposed on the background pattern areas and embellishing the same to provide a pattern of unique composite designs in accordance with the invention. In particular, it is highly efficient and quite inexpensive to provide such an airbrush printing station as an adjunct or attachment to a conventional type of contact printer as the final printing stage or stages thereof, and to synchronize the operation of the airbrushes either by depositing a hard printed pattern, such as the mark on the fabric or by forming a triggering mark or indicator, such as 23, on the periphery of a roller 16 or 19. With this arrangement, the triggering mark can be sensed or read out at the airbrush station so as to positively synchronize and register the superimposed airbrush design features with the previously applied background pattern.

While the preceding disclosure describes and illustrates the contact printing section to be spatially and temporarily located upstream of said airbrush printing section, which is presently preferred, it will be apparent that this arrangement can be reversed without departing from this invention. In such reverse arrangement synchronization between the two sections can be achieved in a variety of ways which will be apparent to one of ordinary skill. For instance, by way of example only, a synchronizing spot could be contact printed at the airbrush station, or airbrush printed, to regulate the contact printer in synchronization with the airbrush printer. Of course, such reversal would find its major utility in the printing of nonrepeating patterns.

While various specific examples and embodiments of the invention have been described in detail above, it should be apparent that other modifications may be made in the specific details described without departing from the spirit and scope of the invention.

I claim:

1. A method of producing a variegated composite design at successive areas along one surface of a length of textile fabric, which comprises:

at a first printing station having a plurality of spaced apart transversely extending contact printing rollers, contact printing with at least one of said contact printing rollers, a first, sharp color background portion of the desired composite design on the surface of the fabric, the contact printed portion of the design being of at least one sharp, ungraduated color and having clear-cut edges;

advancing the fabric from the first station to a second printing station;

at the second station having a plurality of airbrush printing units and being located after the last printing roller, airbrush printing with at least one of said airbrush printing units, a second, variable color tone portion of the desired composite design on the surface of the fabric;

forming a trigger marking along the periphery of one of the rollers at the first printing station at a preset circumferential position with respect to the background pattern deposited on the fabric; and sensing the trigger marking to operate said at least one airbrush printing unit at the second station in synchronism with the operation of said at least one contact printing roller at said first station to register the airbrushed portion of the composite design with the background portion.

2. The method of claim 1, wherein said textile fabric is a thin fabric.

3. The method of claim 1, wherein said textile fabric is a thick fabric.

4. An apparatus for producing a variegated composite design at successive areas along one surface of a length of textile fabric advanced therethrough, which comprises:

a plurality of contact printing rollers mounted in a horizontal row for printing repeating background design patterns in various colors at predetermined repeat intervals along the length of the fabric, one of the rollers having a trigger marking along the periphery thereof at a preset circumferential position with respect to the background pattern printed on the fabric;

means for advancing the fabric in a horizontal plane through the printing apparatus in contact with the printing rollers;

airbrush printing means mounted downstream of the last printing roller for applying variable colortone design features to a selected portion of the background design previously contact printed on the fabric; and means for sensing said trigger marking to operate the airbrush printing means in synchronism with the operation of the contact printing rollers to register the airbrushed portion of the composite design with the background portion.

5. The apparatus as recited in claim 4, wherein the airbrush printing means comprises:

a plurality of airbrush guns positioned at a predetermined distance downstream from the contact printing station; and means for mounting the guns for slideable movement transversely of the line of advancement of the fabric so as to permit transverse adjustment of such guns with respect to the fabric to permit transverse registration of a plurality of airbrushed design features with a corresponding plurality of background design elements previously contact printed thereon.

6. The apparatus as recited in claim 5, wherein the mounting means for the guns further includes means for adjusting the vertical position of each gun so as to set a desired height of each gun above a horizontal plane of the advancing fabric so as to permit variations in the area of the airbrushed design elements applied to the fabric.

7. The apparatus as recited in claim 6, wherein the mounting means further includes means for swivelling each gun about a vertical axis so as to adjust the angular position of each gun with respect to the line of advancement of the fabric so as to permit one or more adjacent guns to cover overlapping areas on the surface of the fabric.

8. The apparatus as recited in claim 7, wherein the mounting means further comprises means for adjusting the angular position of each gun with respect to the horizontal plane of the advancing fabric so as, with the vertical adjustment, to provide variations in the size of the areas covered by the airbrushed patterns.

9. A printing apparatus for printing patterns on a surface of a length of textile fabric advanced therethrough, which comprises:

a rotary print screen mounted for printing a repeating background design pattern at a predetermined repeat interval along the length of the fabric;

a peripheral surface marking on said print screen, the position of the surface marking being predetermined relative to the longitudinal position of a predetermined portion of the background pattern;

means for advancing the fabric in a horizontal plane through the printing apparatus in contact with the print screen;

an airbrush gun mounted downstream of the print screen for applying a variable tone design feature to a selected portion of the background design previously printed on the fabric; and means for detecting each rotation of the surface marking past a fixed reference point for triggering the operation of said airbrush gun at a precise reference registration point with respect to the background design operation to be airbrushed.

10. The printing apparatus recited in claim 9, further comprising:

a slide rod mounted across the printing apparatus transversely above the line of advancement of the fabric;

a mounting block slideably mounted on the slide rod to permit adjustment of the airbrush gun across the width of the fabric to desired airbrushing position; and a vertical support rod for mounting said airbrush gun in said mounting block so that the vertical and angular position of said gun is adjustable relative to the fabric.

11. A printing apparatus for printing patterns on a surface of a length of textile fabric advanced therethrough, which comprises:

a plurality of rotary print screens mounted in a horizontal row for printing repeating background design patterns in various colors at predetermined repeat intervals along the length of the fabric;

a peripheral surface marking on the last print screen in the row before the airbrushes, the position of the surface marking being predetermined relative to the longitudinal position of predetermined portions of the background pattern;

means for advancing the fabric in a horizontal plane through the printing apparatus in contact with the print screens;

a plurality of airbrush guns mounted downstream of the last print screen for applying variable colortone design features to selected portions of the background designs previously printed on the fabric; and means for detecting each rotation of the surface marking past a fixed reference point for triggering the operation of the airbrush guns at a precise reference registration point with respect to the background design portions to be airbrushed.

12. The printing apparatus recited in calim 11, further comprising:

a slide rod mounted across the printing apparatus transversely above the line of advancement of the fabric;

a plurality of mounting blocks slideably mounted on the slide rod to permit adjustment of the airbrush guns across the width of the fabric to desired airbrushing position; and a vertical support rod for mounting each gun in one of the mounting blocks so that the vertical and angular position of the gun with respect to the fabric can be adjusted.

* * * * *